United States Patent [19]

Pora et al.

[11] Patent Number: 4,702,098

[45] Date of Patent: Oct. 27, 1987

[54] REDRAW CARRIAGE ASSEMBLY AND SLIDE MOUNT

[75] Inventors: Tom Pora, Arvada; Tony Grandinetti, Westminster, both of Colo.

[73] Assignee: Ball Corporation, Muncie, Ind.

[21] Appl. No.: 786,446

[22] Filed: Oct. 11, 1985

[51] Int. Cl.[4] ..... B21D 24/08

[52] U.S. Cl. ..... 72/351; 72/347; 92/13.8

[58] Field of Search ..... 72/347, 349, 350, 351, 72/456; 92/13.8; 384/11

[56] References Cited

U.S. PATENT DOCUMENTS

| | | | |
|---|---|---|---|
| 288,840 | 11/1883 | Miles | 72/456 |
| 1,910,534 | 5/1933 | Glasner | 72/456 |
| 3,793,871 | 2/1974 | Kinghorn | 72/349 |
| 4,007,621 | 2/1977 | Franek et al. | 72/347 |
| 4,247,082 | 1/1981 | Sjolund | 92/13.8 |
| 4,581,915 | 4/1986 | Haulsee et al. | 72/349 |

FOREIGN PATENT DOCUMENTS

| | | | |
|---|---|---|---|
| 100920 | 6/1983 | Japan | 72/350 |
| 1115675 | 5/1968 | United Kingdom | 384/11 |

*Primary Examiner*—Lowell A. Larson

*Attorney, Agent, or Firm*—Gilbert E. Alberding

[57] ABSTRACT

Apparatus and method are provided for resiliently clamping a redraw cup (82) against a redraw die (34) in a crank and slide press (144) of the type having a redraw carriage assembly (12) that includes a redraw sleeve (62), and for slidably mounting the redraw carriage assembly (12) to the crank and slide press (144). The apparatus for resiliently clamping the redraw cup (82) against the redraw die (34) includes a fluid actuator (58) that is disposed circumferentially around the longitudinal axis (20) of the redraw die (34) and circumferentially around the redraw punch (46). The apparatus for slidably mounting the redraw carriage assembly to the crank and slide press includes guide rails (86*a*, 86*b*, 90*a*, and 90*b*) and pluralities of rollers (126*a*–126*d*).

9 Claims, 2 Drawing Figures

REDRAW CARRIAGE ASSEMBLY AND SLIDE MOUNT

BACKGROUND OF THE INVENTION

1. Field of the Invention

The present invention relates generally to crank and slide presses for metal working. More particularly, the present invention relates to a crank and slide press for redrawing metallic cups into containers, and to a redraw carriage for crank and slide presses that includes improved apparatus for resiliently clamping the redraw cup between the redraw sleeve and a redraw die.

2. Description of the Prior Art

Crank and slide presses are used for punching, shearing, drawing, and redrawing operations in manufacturing articles from metallic sheets or rolls of metallic strip material.

In general, a crank and slide press includes a crank that is mounted for rotary motion, an electric motor that is connected to the crank and that imparts rotary motion thereto, a slide that is guided for reciprocating motion, and a connecting rod that cooperates with the crank and the slide to change rotary motion into reciprocating motion. A more detailed discussion of crank and slide presses is given by Maytag in U.S. Pat. No. 3,696,657.

One specific use for a crank and slide press is in the production of beverage cans. A redraw cup is drawn from a coiled strip by a first crank and slide press; and then the redraw cup is redrawn on a second crank and slide press by forcing the redraw cup through a tool pack that includes a redraw die and a plurality of ironing dies.

In the highly competitive container industry, the container must be made with the absolute minimum of material, which means that the finished container must have extremely thin walls. Further, because of the competitiveness of the container industry, the speed of the press must be maximized and downtime of the press must be minimized.

As should be apparent, maximizing speed and minimizing downtime are inherently opposite, because higher speeds impose higher stresses on the machinery and cause higher wear rates. Further, it should be apparent that the use of extremely thin walls in the finished containers places stringent accuracy and alignment requirements on such parts as the redraw punch and redraw die.

In the redrawing operation, the tool pack, with the redraw die thereof, is mounted circumferentially around the longitudinal axis along which the redraw punch is reciprocated; the redraw punch is reciprocated toward, into, and through the tool pack, including both the redraw die and the ironing dies; and the redraw punch is withdrawn from the tool pack and all of the parts thereof.

The redraw cup is positioned against the redraw die and is resiliently held against the redraw die by a redraw sleeve; the redraw sleeve is attached to a redraw carriage; and the redraw carriage is reciprocated toward and away from the redraw die.

The redraw sleeve serves two functions. One function of the redraw sleeve is to assure concentricity between the redraw punch and the redraw die. Of course, this concentricity is extremely important because of the thinness of the walls of the finished container and thus the small difference between the diameter of the redraw punch and the redraw die.

The other function of the redraw sleeve is to achieve resilient clamping action between a clamping face of the redraw sleeve, the redraw cup, and the redraw die.

In the prior art, such as typified by the aforesaid patent to Maytag, the redraw carriage has been actuated toward the redraw die by a cam that is attached to the crank of the press, and by a cam follower mechanism that receives motion from the cam and that transfers this motion to the carriage. It has been customary to use an air cylinder to maintain the cam follower in contact with the cam and to actuate the redraw carriage away from the redraw die.

It is important that the redraw sleeve resiliently hold the redraw cup against the redraw die with sufficient force to promote accurate redrawing as opposed to allowing the redraw cup to collapse and wrinkle as it enters the redraw die; but it is equally important to limit the clamping force of the redraw sleeve below a clamping force that will cause any of the redraw cups to rupture rather than being redrawn.

In the prior art, as exemplified in the aforesaid patent to Maytag, a spring mechanism has been interposed between the redraw cam and the redraw carriage in order to limit the clamping force of the redraw sleeve. While this construction has been, in general, satisfactory in the past, decreases in the thickness of the walls of beverage containers, and increases in press operating speeds have made the prior art apparatus inadequate for present needs.

More particularly, it is well-known that, at high compression velocities, a pressure wave is transmitted through a spring; so that the force actually exerted by the spring varies widely from the static force of the spring. Thus, in redraw operations, the clamping force of a spring will vary considerably from that which the spring would exert under static, or low speed, conditions.

Further, it can be appreciated that, with operating speeds of approximately two hundred and fifty redraw operations per minute, the compression wave may be oscillating back and forth in the clamping spring for a higher percentage of the time, or even the entire time, in which the redraw cup is held between the redraw sleeve and the redraw die; so the clamping force of the spring varies greatly during the clamping operation.

It can be appreciated that, if the actual clamping force is varying widely due to the compression waves in the clamping spring, then an excessively large portion of the satisfactory range in the clamping force is taken by the spring-caused variations in the clamping force; and the adjustment range for satisfactory operation becomes much more critical.

Further, it is important to make adjustments to the redraw press while the press is operating. It can be understood that, if the press is stopped, a small adjustment is made, a short run is made to observe the results of the change, the press is stopped again, etc., considerable production is lost. Because of the loss of production through stopping the press to make adjustments, there is the tendency to avoid making the number of minor adjustments that should be made to optimize the clamping force, and there is a tendency to delay making adjustments as long as possible, even though a more optimum clamping force would result in fewer rejects in the finished containers.

Thus, a principal object of the present invention is to provide apparatus and method for resiliently clamping a redraw cup between a redraw sleeve and a redraw die.

Another object of the present invention is to provide apparatus and method for resiliently clamping a redraw cup between a redraw sleeve and a redraw die that provides a uniform pressure during a high percentage of the time in which the redraw cup is clamped.

Still another object of the present invention is to provide apparatus and method for the clamping operation as described in which the effect of spring pressure-wave forces is eliminated.

Finally, it is an object of the present invention to provide apparatus and method as described in which the clamping force can be adjusted without stopping the crank and slide press.

SUMMARY OF THE INVENTION

In the present invention, a redraw carriage body is mounted to a crank and slide press by first and second guide rails that are disposed longitudinally and that are attached to the redraw carriage body, by third and fourth guide rails that are disposed longitudinally, that are positioned outside of respective ones of the first and second guide rails, that are attached to the crank and slide press, and that are connected to respective ones of the first pair of guide rails by longitudinally disposed grooves and pluralities of rollers that are disposed between proximal pairs of the guide rails.

The redraw carriage body is reciprocated along a longitudinal axis toward, and away from, the redraw die by a pair of actuating arms. The actuating arms may be reciprocated by any suitable mechanism (not a part of the present invention), such as a cam, cam follower, and pneumatic return mechanism, as taught by the prior art.

A redraw punch is reciprocated along the longitudinal axis, into and through a tool pack which includes both the redraw die and a plurality of ironing dies, and is withdrawn from the tool pack. Typically, the mechanism for reciprocating the redraw punch is a crank of a crank and slide press; although the particular mechanism for reciprocating the redraw punch is not a part of the present invention.

The redraw carriage body includes a first, or larger, cylindrical bore that is disposed circumferentially around the longitudinal axis and the redraw punch, and a second, or smaller cylindrical bore that is disposed circumferentially around the longitudinal axis and the redraw punch, that communicates with the first cylindrical bore, and that opens through the redraw carriage body distal from the redraw die.

A redraw piston includes a larger cylindrical portion that is slidably disposed in the first, or larger, circumferential bore, and a smaller cylindrical portion that is slidably disposed in the second, or smaller, cylindrical bore. The redraw piston cooperates with the cylindrical bores to provide a fluid actuator; and the projected area between the larger and smaller cylindrical portions of the redraw piston provides the actuating area of the fluid actuator.

A pressurized fluid, preferably air, is supplied to the fluid actuator; and the fluid pressure is controlled, and selectably adjusted, by a pressure regulator.

A redraw sleeve is disposed circumferentially around the redraw punch, is attached to the redraw carriage body, and includes a clamping face that is disposed circumferentially around the redraw punch.

BEST MODE FOR CARRYING OUT THE INVENTION

Figure 1:
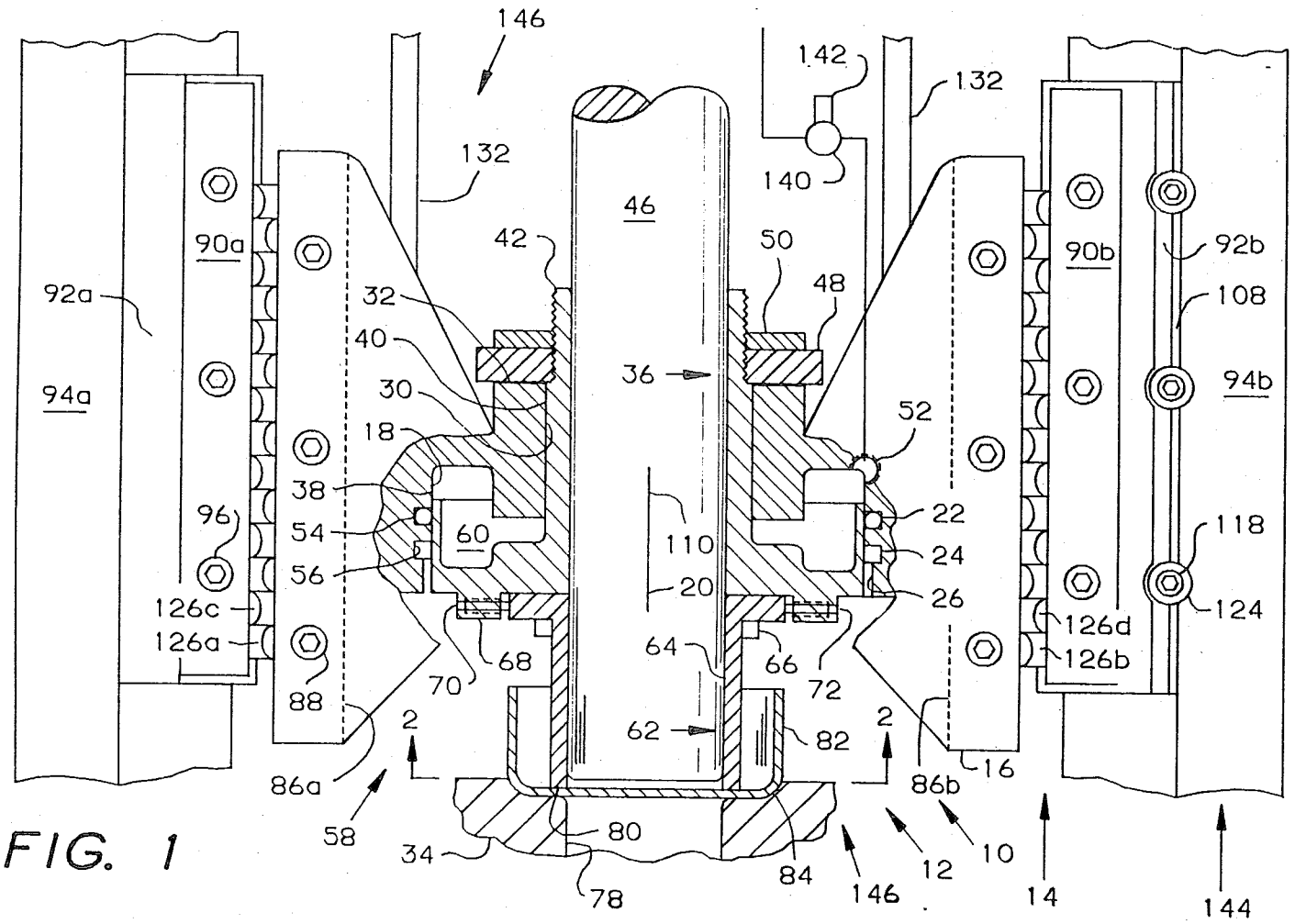
FIG. 1 is a top view of a preferred embodiment of the present invention, showing a portion of the redraw carriage assembly in cross section to better illustrate the fluid actuator thereof, and showing a redraw cup being resiliently clamped between the redraw sleeve and a redraw die.

Referring now to the drawings, a redraw carriage assembly and slide mount 10 includes a redraw carriage assembly 12 and a slide mount 14.

The redraw carriage assembly 12 includes a redraw carriage body 16 having a first, or larger, cylindrical bore 18 therein that is disposed circumferentially around a longitudinal axis 20, having a seal groove 22 that is disposed circumferentially in the first cylindrical bore 18, having a wiper groove 24 that is disposed circumferentially in the first cylindrical bore 18 and that is longitudinally spaced apart from the seal groove 22, and having a cylindrical relief portion 26 that is disposed circumferentially around the longitudinal axis 20 and that is disposed longitudinally intermediate of the wiper groove 24 and an end 28 of the redraw carriage body 16.

The redraw carriage body 16 includes a second, or smaller, cylindrical bore 30 that is disposed circumferentially around the longitudinal axis 20, that communicates with the first cylindrical bore 18, and that opens through an end 32 of the redraw carriage body 16 that is distal from a redraw die 34.

A clamping piston 36 includes a larger cylindrical portion 38 that is slidably disposed in the first cylindrical bore 18, a smaller cylindrical portion 40 that is slidably disposed in the second cylindrical bore 30 and that extends through the second cylindrical bore 30 distal from the redraw die 34, and a threaded portion 42.

The clamping piston 36 further includes a punch bore 44 that is disposed circumferentially around the longitudinal axis 20, that extends through the larger cylindrical portion 38, the smaller cylindrical portion 40, and the threaded portion 42, and that accepts a redraw punch 46 therethrough.

The redraw carriage assembly 12 includes the redraw carriage body 16, the clamping piston 36, a threaded stop collar, or an adjusting nut, 48 that is threadingly attached to the threaded portion 42 of the clamping piston 36, a lock nut 50 that is threadingly attached to the threaded portion 42, a threaded port 52 that is drilled and tapped into the redraw carriage body 16, a resilient seal 54 that is disposed in the seal groove 22 and that provides a seal between the clamping piston 36 and the bore 18 of the redraw carriage body 16, and a wiper 56 that is disposed in the wiper groove 24 and that excludes dirt from the first cylindrical bore 18.

The clamping piston 36, together with the larger cylindrical portion 38 and the smaller cylindrical portion 40 thereof, cooperate with the first cylindrical bore 18 and the second cylindrical bore 30 to provide a fluid actuator 58 that is disposed circumferentially around the longitudinal axis 20, that is disposed circumferentially around the redraw punch 46, and that has an actuating area 60 which consists of the projected area between the smaller cylindrical portion 40 and the larger cylindrical portion 38.

The redraw carriage assembly 12 also includes a redraw sleeve 62 that includes a punch bore 64, that is disposed circumferentially around the longitudinal axis 20, and that is disposed circumferentially around the redraw punch 46.

The redraw sleeve 62 is attached to the clamping piston 36 by a plurality of bolts 66; and the redraw sleeve 62 is radially positioned by adjusting lugs 68 that project longitudinally outward from the clamping piston 36, by first threaded holes 70 that are radially disposed in the adjusting lugs 68, by first set screws 72 in the first threaded holes 70, by second threaded holes 74 that intercept the first threaded holes 70 orthogonally, and by second set screws 76 that are screwed against the first set screws 72. Thus, means is provided for radially adjusting the redraw sleeve 62 and for guidingly positioning the redraw punch 46 radially with respect to a die opening 78 in the redraw die 34.

The redraw sleeve 62 includes a clamping face 80 that is disposed circumferentially around the longitudinal axis 20 and the redraw punch 46. In operation, a redraw cup 82 is resiliently clamped between the clamping face 80 of the redraw sleeve 62 and a face 84 of the redraw die 34.

The slide mount 14 includes first and second guide rails, 86*a* and 86*b*, that are longitudinally disposed, that are spaced apart, and that are attached to the redraw carriage body 16 by bolts 88.

The slide mount 14 also includes: third and fourth guide rails, 90*a* and 90*b*, that are spaced outside of, parallel to, and proximal to respective ones of the first and second guide rails, 86*a* and 86, first and second frame members, 92*a* and 92*b*, that are spaced parallel to respective ones of said third and fourth guide rails, 90*a* and 90*b*, and third and fourth frame members 94*a* and 94*b*. The third and fourth guide rails, 90*a* and 90*b*, are attached to respective ones of the first and second frame members, 92*a* and 92*b*, and to respective ones of the third and fourth frame members, 94*a* and 94*b*, by bolts 96.

The first and second guide rails, 86*a* and 86*b*, respectively include longitudinally disposed first and second grooves, 98*a* and 98*b*, that are disposed intermediate of the first and second guide rails, 86*a* and 86*b*, and respective ones of the third and fourth guide rails, 90*a* and 90*b*.

In like manner, the third and fourth guide rails, 90*a* and 90*b*, respectively include longitudinally disposed third and fourth grooves, 100*a* or 100*b*, that are disposed intermediate of the third and fourth guide rails, 90*a* or 90*b*, and respective ones of the first and second guide rails, 86*a* or 86*b*.

Figure 2:
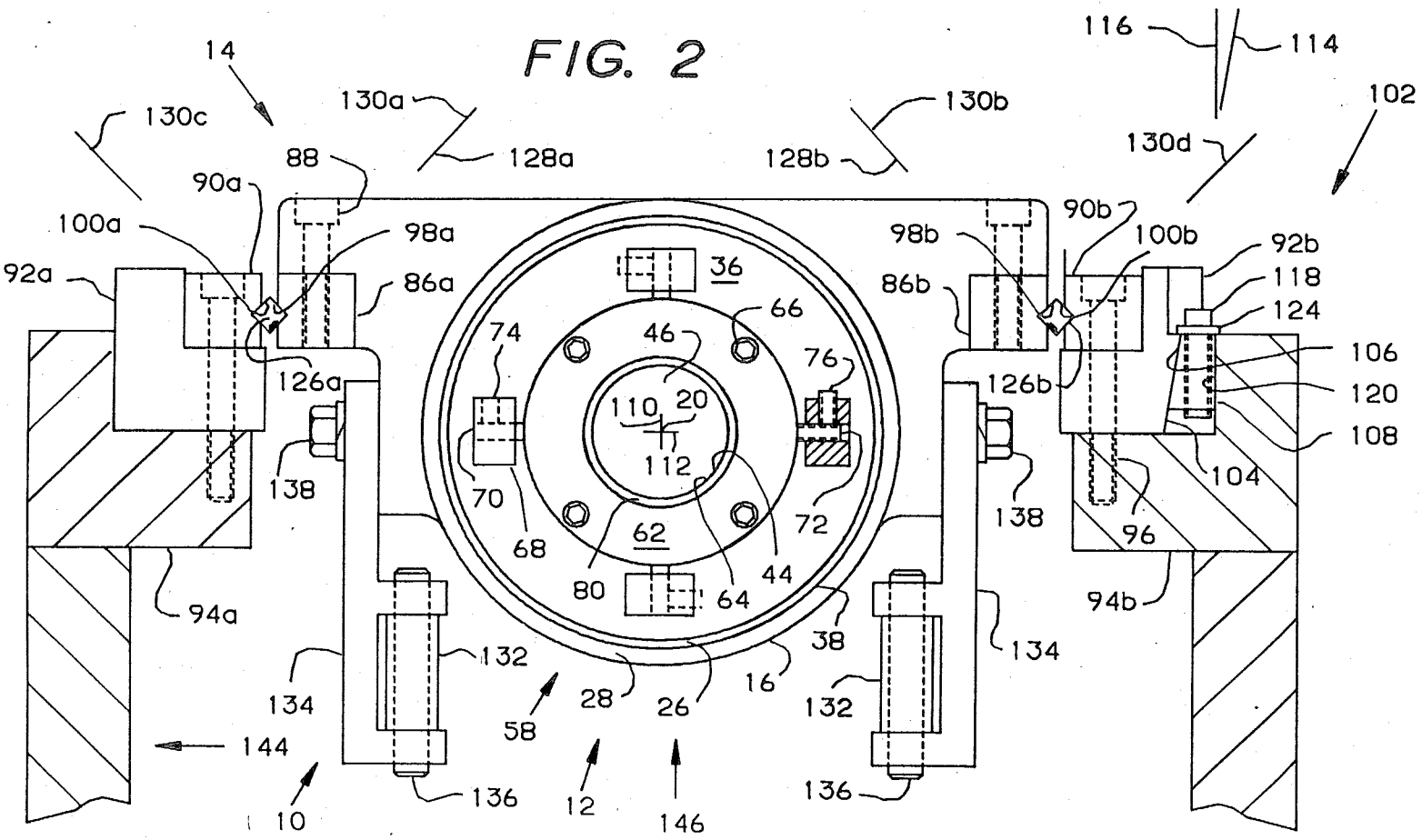
FIG. 2 is a front elevation of the embodiment of FIG. 1, taken substantially as shown by view line 2—2 of FIG. 1, and looking toward the crank (not shown) of the crank and slide press.

Preferably, the grooves 98*a*, 98*b*, 100*a* , and 100*b* are V-shaped in cross section, as shown in FIG. 2, and preferably the included angle of each groove is ninety degrees, as shown.

Pluralities of rollers, which will be numbered and described subsequently, are disposed between the first and second grooves, 98*a* and and respective ones of the third and fourth grooves 100*a* and 100*b*.

The slide mount 14 includes adjusting means 102 that includes a first wedge surface 104 on the second frame member 92*b* and a second wedge surface 106 on an adjusting wedge 108.

As seen in FIG. 2, the longitudinal axis 20 lies along the intersection of a first plane 110 and a second plane 112 that are orthogonally disposed to each other; and the first and second wedge surfaces, 104 and 106, are in a third plane 114 that is parallel to the longitudinal axis 20 and that intercepts both the first plane 110 and the second plane 112.

In operation, the adjusting wedge 108 is selectively adjusted in a fourth plane 116 that is parallel to the first plane 110 by a plurality of adjusting bolts 118, the adjusting wedge 108 being restrained against movement in the second plane 112 by a surface 120 of the fourth frame member 94*b*.

Each of the adjusting bolts 118 includes a washer 124 that is supported on one diametrical side thereof by the second frame member 92*b*, and on the other diametrical side thereof by the fourth frame member 94*b*; so that screwing the adjusting bolts 118 downward into the adjusting wedge 108 is effective to pull the adjusting wedge 108 toward the washers 124 and force the fourth guide rail 90*b* toward the second guide rail 86*b*.

The plurality of first rollers 126*a* are disposed in the first groove 98*a* and in the third groove 100*a*; and a plurality of second rollers 126*b* are disposed in the second groove 98*b* and in the fourth groove 100*b*. Roller axes 128*a* of the first rollers 126*a* are in a fifth plane 130*a* and roller axes 128*b* of second rollers 126*b* are in a sixth plane 130*b*.

A plurality of third rollers 126*c* are interposed between individual ones of the first rollers 126*a* as shown in FIG. 2; and the roller axes (not shown) of third rollers 126*c* are in a seventh plane 130*c* that is orthogonal to the fifth plane 130*a*. In like manner a plurality of fourth rollers 126*d* are interposed between individual ones of the second rollers 126*b*; and the roller axes (not shown) of the fourth rollers 126*d* are in an eighth plane 130*d* that is orthogonal to the sixth plane 130*b*.

Thus, the redraw carriage assembly 12 is guided along the longitudinal axis 20 by rollers 126*a*–126*d* that are disposed in four planes, 130*a*–130*d*.

The redraw carriage assembly 12 is reciprocated along the longitudinal axis 20, both proximal to and distal from the redraw die 34 by longitudinally disposed actuating arms 132. The actuating arms 132 are attached to the carriage body 16 by actuating links 134 that are connected to the actuating arms 132 by pins 136, and by bolts 138 that connect the actuating links 134 to the redraw carriage body 16.

The actuating arms 132 are actuated by any suitable means, not a part of the present invention, which may include a cam, a cam follower, and a pneumatic cylinder, as taught by Maytag in the aforementioned patent.

In operation, pressurized fluid, preferably compressed air, is supplied to the fluid actuator 58 through a pressure regulator 140 having a manual pressure adjustment control 142; and the fluid pressure in the fluid actuator 58 is adjusted to provide the optimum clamping force between the clamping face 80 of the redraw sleeve 62, the redraw cup 82, and the redraw die 34.

In summary, the present invention provides a redraw carriage assembly 12 and slide mount 14 for use in a metal working crank and slide press 144 of the type having a redraw die 34, having a redraw punch 46 that is reciprocated along a longitudinal axis 20 and into the redraw die 34, having a redraw carriage 146 that is actuated along the longitudinal axis 20 to positions both proximal to and distal from the redraw die 34, and having a redraw sleeve 62 that is attached to the redraw carriage 146;

The guide rails 86*a*, 86*b*, 90*a*, and 90*b*, together with the rollers, 126*a*–126*d*, provide means for slidably mounting and for guiding the redraw carriage assembly 12 along with the longitudinal axis 20; and The cylindrical portions 38 and 40 cooperate with respective ones of the cylindrical bores, 18 and 30, to provide actuator means 58 for resiliently urging the redraw sleeve 62 toward the redraw die 34, and for resiliently clamping a redraw cup 82 against the redraw die 34 when the redraw carriage assembly 12 is actuated to a position proximal to the redraw die 34.

The redraw carriage 146 includes the redraw carriage body 16, the clamping piston 36, the adjusting nut 48, the lock nut 50, the resilient seal 54, and the wiper 56. The redraw carriage assembly 12 includes the redraw carriage 146, the redraw sleeve 62, the bolts 66, the set screws 72, and the set screws 76. The redraw carriage assembly and slide mount 10 includes the redraw carriage assembly 12 and the slide mount 14.

While specific apparatus and method have been disclosed in the preceding description, it should be understood that these specifics have been given for the purpose of disclosing the principles of the present invention and that many variations thereof will become apparent to those who are versed in the art. Therefore, the scope of the present invention is to be determined by the appended claims.

INDUSTRIAL APPLICABILITY

The present invention is applicable to crank and press apparatus of the type that includes a redraw carriage. More particularly, the present invention is applicable for use in the redraw operation in the manufacture of beverage cans.

What is claimed is:

1. A redraw carriage assembly and slide mount for use in a metal working crank and slide press of the type having a redraw die, having a redraw punch that is reciprocated along a longitudinal axis and into said redraw die, and having a redraw carriage that is slidably mounted to said press and that is actuated along said longitudinal axis to positions both proximal to and distal from said redraw die, which redraw carriage assembly comprises:

a carriage body, having a larger cylindrical bore that is disposed circumferentially around said longitudinal axis and that opens toward said redraw die, and having a smaller cylindrical bore that is disposed circumferentially around said longitudinal axis, that communicates with said larger cylindrical bore, and that opens through said carriage body distal from said redraw die;

a clamping piston, having a larger cylindrical portion that is slidably disposed in said larger cylindrical bore, having a smaller cylindrical portion that is slidably disposed in said smaller cylindrical bore, and having a punch bore that extends through both of said cylindrical portions, and that is disposed circumferentially around said redraw punch:

a redraw sleeve having bore means therein for receiving said redraw punch, being disposed circumferentially around said redraw punch, having a clamping face that is disposed circumferentially around said bore means, and being operatively attached to said clamping piston; and said clamping piston includes means for adjustably limiting movement of said redraw sleeve in the direction toward said redraw die.

2. A redraw carriage and slide mount as claimed in claim 1 in which said means for adjustably limiting comprises a threaded portion of said smaller cylindrical portion 9 .

3. A redraw carriage and slide mount as claimed in claim 1 in which said means for adjustably limiting comprises a stop collar that is operatively attached to said smaller cylindrical portion of said clamping piston, that is longitudinally positionable on said smaller cylindrical portion, and that operatively engages said carriage body.

4. A metal working crank and slide press of the type having a redraw die, having a redraw punch that is reciprocated along a longitudinal axis and into said redraw die, and having a redraw carriage assembly that is slidably mounted to said press and that is actuated along said longitudinal axis to positions both proximal to and distal from said redraw die, and having a slide mount that mounts said redraw carriage assembly to said crank and slide press, in which said redraw carriage assembly and slide mount comprises:

a carriage body, having a larger cylindrical bore that is disposed circumferentially around said longitudinal axis and that opens toward said redraw die, and having a smaller cylindrical bore that is disposed circumferentially around said longitudinal axis, that communicates with said larger cylindrical bore, and that opens through said carriage body distal from said redraw die;

means, comprising first and second guide rails that are longitudinally disposed and parallel spaced apart, for slidably mounting said carriage body to said press, and for guiding said carriage body along said longitudinal axis;

a clamping piston, having a punch bore that is disposed circumferentially around said redraw punch, having a larger cylindrical portion that slidably engages said larger cylindrical bore, and having a smaller cylindrical portion that slidably engages said smaller cylindrical bore;

a redraw sleeve having bore means therein for guiding said redraw punch, being disposed circumferentially around said redraw punch, having a clamping face that is disposed circumferentially around said bore means, and being operatively attached to said clamping piston; and said clamping piston includes means, comprising said smaller cylindrical portion, for adjustably limiting movement of said clamping piston in the direction toward said redraw die.

5. A crank and slide press as claimed in claim 4 in which said means for adjustably limiting movement comprises a threaded portion of said smaller cylindrical portion.

6. A crank and slide press as claimed in claim 4 in which said means for adjustably limiting comprises a stop collar that is operatively attached to said smaller cylindrical portion of said clamping piston, that is longitudinally positionable on said smaller cylindrical portion, and that operatively engages said carriage body distal from said redraw die.

7. A method for resiliently clamping a redraw cup against a redraw die in a crank and slide press of the type having a redraw die, having a redraw punch that is reciprocated along a longitudinal axis and into said redraw die, and having a redraw carriage body that is actuated along said longitudinal axis to positions both proximal to and distal from said redraw die, which method comprises:

providing a larger cylindrical bore in said carriage body that is disposed circumferentially around said redraw punch and that opens toward said redraw die;

providing a smaller cylindrical bore in said carriage body that is disposed circumferentially around said redraw punch, that communicates with said larger cylindrical bore, and that opens through said carriage body distal from said redraw die;

providing a clamping piston that includes a first circumferential portion of said larger diameter, that includes second circumferential portion of smaller diameter and that includes a punch bore through both of said circumferential portions;

disposing said clamping piston circumferentially around said redraw punch;

slidably disposing said first circumferential portion in said larger cylindrical bore;

slidably disposing said second circumferential portion in said smaller bore;

providing means for adjustably limiting longitudinal movement of said clamping piston in the direction toward said redraw die; and supplying pressurized air to said clamping piston intermediate of said larger and smaller portions.

8. A method as claimed in claim 7 in which said step of disposing said second circumferential portion in said smaller bore comprises extending said second circumferential portion through said smaller bore; and said step of providing means for adjustably limiting comprises providing an adjustable stop that is disposed external of said smaller bore and proximal thereto, that is disposed circumferentially around said second circumferential portion, that is operatively attached to said second circumferential portion, that is adjustable longitudinally toward and away from said first circumferential portion and that engages said carriage body distal from said redraw die.

9. A method as claimed in claim 7 in which said step of providing means for adjustably limiting comprises operatively attaching a stop collar to said second circumferential portion, and selectively positioning said stop collar with respect to said first circumferential portion.

* * * * *